US008657673B2

(12) United States Patent
Sprinkle

(10) Patent No.: US 8,657,673 B2
(45) Date of Patent: Feb. 25, 2014

(54) GAMING MACHINE WITH WAGER REALLOCATION FEATURE

(75) Inventor: Jason Todd Sprinkle, Pauline, SC (US)

(73) Assignee: Video Gaming Technologies, Inc., Brentwood, TN (US)

( * ) Notice: Subject to any disclaimer, the term of this patent is extended or adjusted under 35 U.S.C. 154(b) by 96 days.

(21) Appl. No.: 13/332,726

(22) Filed: Dec. 21, 2011

(65) Prior Publication Data

US 2012/0202585 A1 Aug. 9, 2012

Related U.S. Application Data

(63) Continuation-in-part of application No. 13/021,060, filed on Feb. 4, 2011, now Pat. No. 8,282,479.

(51) Int. Cl.
*G07F 17/32* (2006.01)

(52) U.S. Cl.
USPC ..... 463/25; 463/16; 463/20; 463/29

(58) Field of Classification Search
USPC ..... 463/16–20, 25–29
See application file for complete search history.

(56) References Cited

U.S. PATENT DOCUMENTS

| | | | | |
|---|---|---|---|---|
| 4,856,787 | A | 8/1989 | Itkis | |
| 6,159,095 | A | 12/2000 | Frohm et al. | |
| 7,708,633 | B2 | 5/2010 | Lind et al. | |
| 2007/0026936 | A1 | 2/2007 | Gatto et al. | |
| 2007/0099696 | A1 | 5/2007 | Nguyen et al. | |
| 2008/0026831 | A1 | 1/2008 | Wright et al. | |
| 2008/0176635 | A1 | 7/2008 | Randall | |
| 2008/0176644 | A1 | 7/2008 | Okada | |
| 2008/0254867 | A1 | 10/2008 | Fujimoto et al. | |
| 2009/0082082 | A1 | 3/2009 | Carr-Gregg et al. | |
| 2009/0291738 | A1 | 11/2009 | Visser | |
| 2010/0004054 | A1 | 1/2010 | Acres | |
| 2010/0048288 | A1 | 2/2010 | Canterbury et al. | |
| 2010/0120486 | A1* | 5/2010 | DeWaal et al. | 463/16 |
| 2010/0210353 | A1 | 8/2010 | Gagner et al. | |

* cited by examiner

*Primary Examiner* — Omkar Deodhar
(74) *Attorney, Agent, or Firm* — Armstrong Teasdale LLP

(57) ABSTRACT

A gaming machine includes a display device and a processor coupled to the display device. The processor is programmed to cause the display device to display a plurality of games using a plurality of frames and to partially execute at least a first game of the plurality of games to create an intermediate game play outcome. The processor is also programmed to cause the display device to display the intermediate game play outcome and a wager reallocation input, to transfer, based on the wager reallocation input, at least a portion of a first wager associated with the first game to a second game of the plurality of games, and to enable play of the second game based on a second wager associated with the second game and the transferred portion of the first wager.

20 Claims, 7 Drawing Sheets

GAMING MACHINE WITH WAGER REALLOCATION FEATURE

CROSS-REFERENCE TO RELATED APPLICATIONS

This application is a continuation-in-part of prior application Ser. No. 13/021,060, filed 4 Feb. 2011, now U.S. Pat. No. 8,282,479 which is hereby incorporated by reference in its entirety.

BACKGROUND OF THE INVENTION

The embodiments described herein relate generally to gaming machines and, more particularly, to systems and methods for enabling a player to allocate and/or reallocate a wager among multiple games.

At least some known gaming machines provide a plurality of concurrent games to a player. For example, at least some known gaming machines enable a player pre-select a desired number of games to play and to place a wager, which is split across a plurality of games. However, the player may be restricted to the wagers that are initially distributed to the games. Such systems require the player to leave a wager applied to a game, regardless of the odds of the game resulting in a winning outcome. For example, during play of one game, a low probability of winning may become apparent to the player, but the player may not be allowed to transfer the wager away from the game that represents a high risk of loss.

BRIEF DESCRIPTION OF THE INVENTION

In one aspect, a gaming machine is provided. The gaming machine includes a display device and a processor coupled to the display device. The processor is programmed to cause the display device to display a plurality of games using a plurality of frames, and to partially execute at least a first game of the plurality of games to create an intermediate game play outcome. The processor is also programmed to cause the display device to display the intermediate game play outcome and a wager reallocation input. The processor is further programmed to transfer, based on the wager reallocation input, at least a portion of a first wager associated with the first game to a second game of the plurality of games, and to enable play of the second game based on a second wager associated with the second game and the transferred portion of the first wager.

In another aspect, a gaming system is provided. The gaming system includes at least one gaming machine and a gaming server coupled to the at least one gaming device via a network. The at least one gaming machine includes a display device configured to a plurality of games using a plurality of frames. The gaming server is configured to, during play of a first game of the plurality of games, cause the display device to display an intermediate game play outcome and a wager reallocation input. The intermediate game play outcome is associated with the first game. The gaming server is also configured to transfer, based on the wager reallocation input, at least a portion of a first wager associated with the first game to a second game of the plurality of games, and to enable play of the second game based on a second wager associated with the second game and the transferred portion of the first wager.

In yet another aspect, a method for use with a gaming machine having a display device is provided. The method includes displaying by the display device a plurality of games in a plurality of frames. At least a first game of the plurality of games is partially executed by a processor to create an intermediate game play outcome. The display device displays the intermediate game play outcome and a wager reallocation input. At least a portion of a first wager associated with the first game is transferred by a processor to a second game of the plurality of games based on the wager reallocation input.

DETAILED DESCRIPTION OF THE INVENTION

Exemplary embodiments of systems and methods for use in dividing a single gaming session into multiple gaming sessions and for reallocating wagers between gaming sessions on a gaming machine are described herein. The embodiments described herein enhance an entertainment aspect of the game, while not requiring additional wagers by a player and while allowing the player to reallocate wagers to games that are relatively likely to result in a winning outcome.

Exemplary technical effects of systems and methods described herein include at least one of: (a) displaying a plurality of games using a plurality of frames; (b) partially executing at least a first game of the plurality of games to create an intermediate game play outcome; (c) displaying the intermediate game play outcome and a wager reallocation input prompting a player to enter a reallocation request; (d) transferring, based on the reallocation request entered by the player, at least a portion of a first wager associated with the first game to a second game of the plurality of games; and (e) enabling play of the second game based on a second wager associated with the second game and the transferred portion of the first wager.

Figure 1:
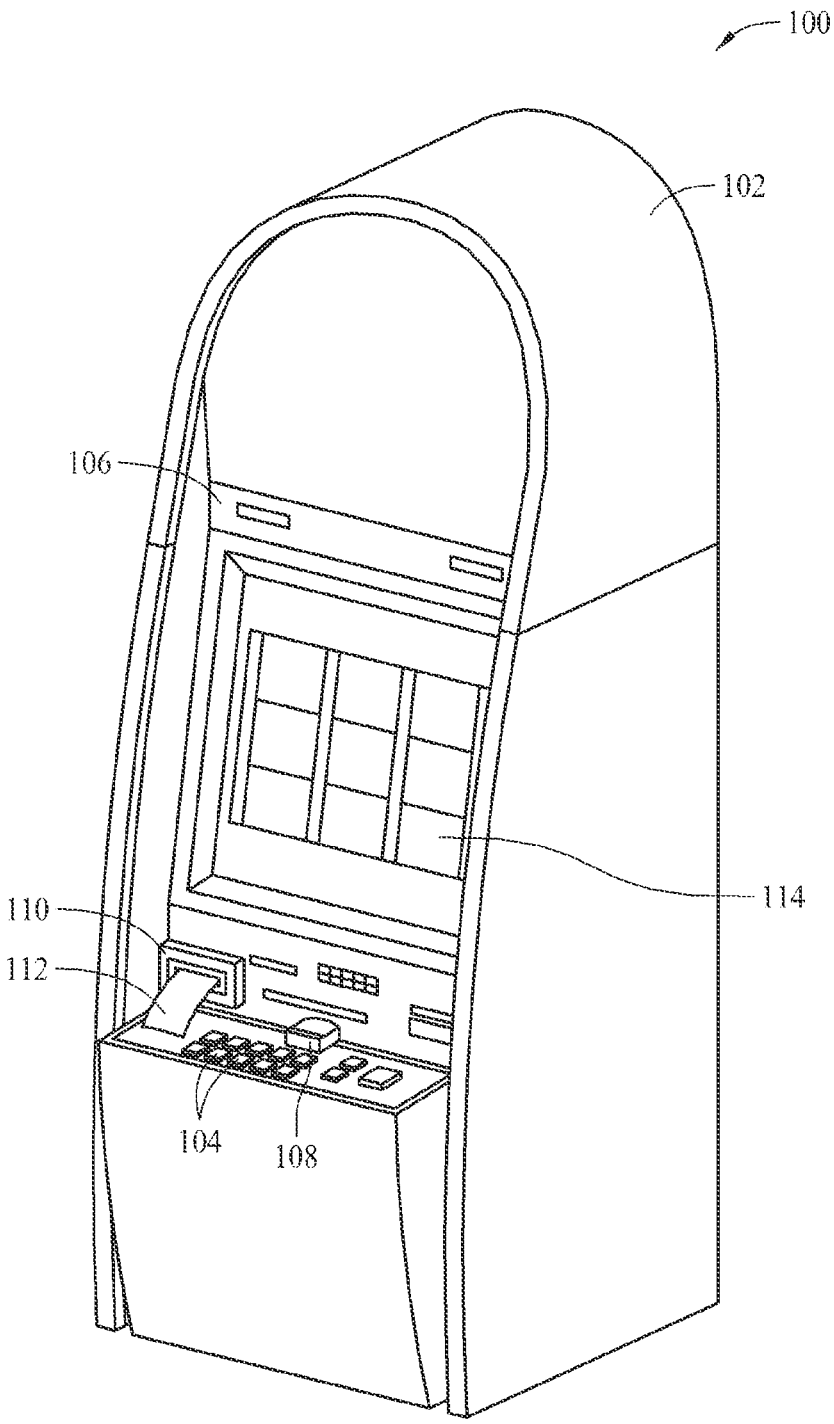
FIG. 1 is a schematic diagram of an exemplary gaming machine.

FIG. 1 is a schematic diagram of an exemplary gaming machine 100 that enables a player to split or divide a game in a first frame into a desired number of second frames that each enable continued play of the game, and/or to reallocate at least a portion of a wager from one game to another. Gaming machine 100 may be any type of gaming machine, and may include, without limitation, different structures than those shown in FIG. 1. Moreover, gaming machine 100 may employ different methods of operation than those described below.

In the exemplary embodiment, gaming machine 100 includes a cabinet 102 configured to house a plurality of components, such as a gaming machine controller, peripheral devices, display devices, and player interaction devices. For example, in an exemplary embodiment, gaming machine 100 includes a plurality of switches and/or buttons 104 that are coupled to a front 106 of cabinet 102. Buttons 104 may be used to start play of a primary or secondary game. One button 104 may be a "Bet One" button that enables the player to place a bet or to increase a bet. Another button 104 may be a "Bet Max" button that enables the player to bet a maximum permitted wager. Yet another button 104 may be a "Cash Out" button that enables the player to receive a cash payment or other suitable form of payment, such as a ticket or voucher, which corresponds to a number of remaining credits.

In the exemplary embodiment, gaming machine 100 also includes a coin acceptor 108 for accepting coins and/or tokens, and a bill acceptor 110 for accepting and/or validating cash bills, coupons, and/or ticket vouchers 112. Bill acceptor 110 may also be capable of printing tickets 112 as is described in greater detail below. Furthermore, in some embodiments, bill acceptor 110 includes a card reader or validator for use with credit cards, debit cards, identification cards, and/or smart cards. The cards accepted by bill acceptor 110 may include a magnetic strip and/or a preprogrammed microchip that includes a player's identification, credit totals, and any other relevant information that may be used. Moreover, in the exemplary embodiment, gaming machine 100 includes one or more display devices 114. Display devices 114 are mounted to cabinet 102, and may include a primary display device for displaying a primary game and a secondary display device for displaying a secondary or bonus game. Display devices 114 may include, without limitation, a plasma display, a liquid crystal display (LCD), and/or a display based on light emitting diodes (LEDs), organic light emitting diodes (OLEDs), polymer light emitting diodes (PLEDs), and/or surface-conduction electron emitters (SEDs). In an exemplary embodiment, display device 114 is used to display one or more game image, symbols and indicia such as a visual representation or exhibition of movement of an object such as a mechanical, virtual, or video reel, dynamic lighting, video images, and the like. In an alternative embodiment, display device 114 displays images and indicia using mechanical means. For example, display device 114 may include an electromechanical device, such as one or more rotatable reels, to display a plurality of game or other suitable images, symbols, or indicia.

In one embodiment, gaming machine 100 randomly generates game outcomes using probability data. For example, each game outcome is associated with one or more probability values that are used by gaming machine 100 to determine the game output to be displayed. Such a random calculation may be provided by a random number generator, such as a true random number generator, a pseudo-random number generator, or any other suitable randomization process.

Figure 2:
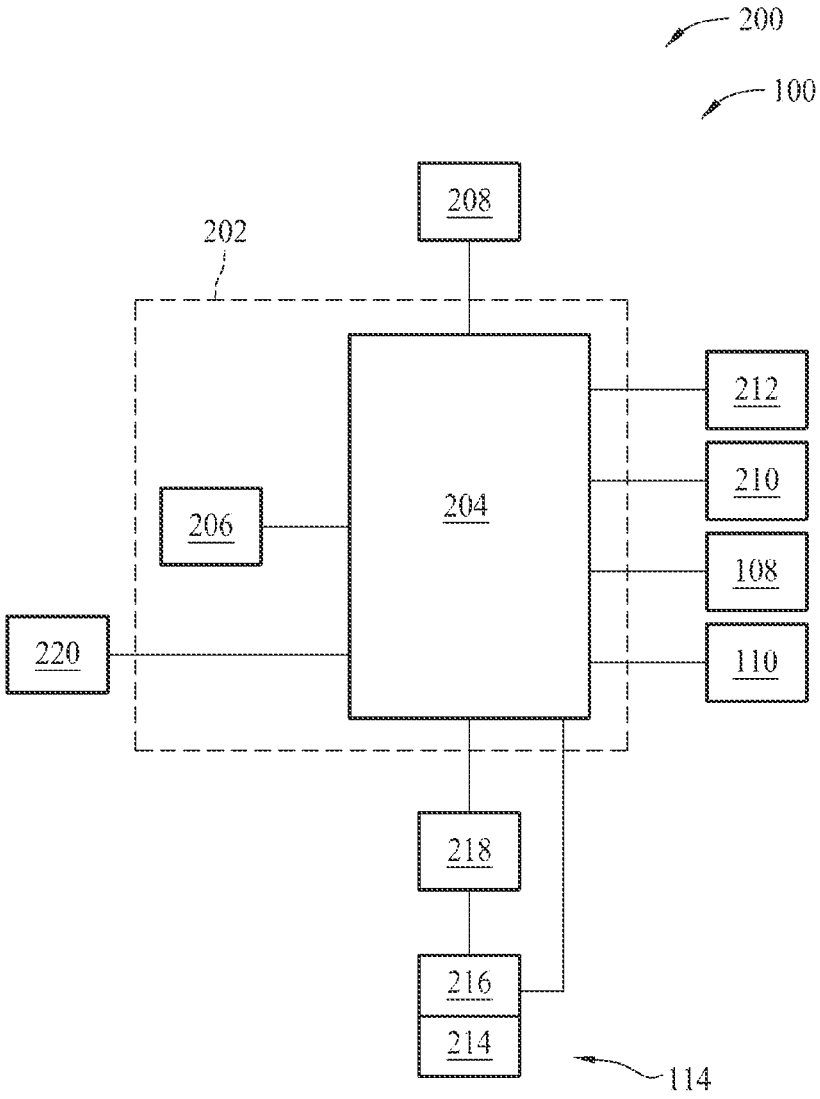
FIG. 2 is a schematic block diagram of an exemplary electrical architecture that may be used with the gaming machine shown in FIG. 1.

FIG. 2 is a schematic block diagram of an exemplary electrical architecture 200 that may be used with gaming machine 100. In the exemplary embodiment, gaming machine 100 includes a gaming machine controller 202 having a processor 204 communicatively coupled a memory area 206. Moreover, in the exemplary embodiment, processor 204 and memory area 206 reside within cabinet 102 (shown in FIG. 1) and may be collectively referred to herein as a "computer" or "controller." Controller 202 communicates with one or more other gaming machines 100 or other suitable devices via a network interface 208. Processor 204 may be a microprocessor, a microcontroller-based platform, a suitable integrated circuit, and/or one or more application-specific integrated circuits (ASICs). However, the above examples are exemplary only, and thus are not intended to limit in any way the definition and/or meaning of the term "processor."

Memory area 206 stores program code and instructions, executable by processor 204, for controlling gaming machine 100. For example, memory area 206 stores data such as image data, event data, player input data, random or pseudo-random number generation software, paytable data, and/or other information or applicable game rules that relate to game play on gaming machine 100. Moreover, memory area 206 may include one or more forms of memory. For example, memory area 206 can include random access memory (RAM), read-only memory (ROM), flash memory, and/or electrically erasable programmable read-only memory (EEPROM). In some embodiments, other suitable magnetic, optical, and/or semiconductor-based memory may be included in memory area 206 by itself or in combination.

In the exemplary embodiment, gaming machine 100 includes a credit display 210, which displays a player's current number of credits, cash, account balance or the equivalent. Gaming machine 100 also includes a bet display 212 which displays a player's amount wagered. Credit display 210 and bet display 212 may be standalone displays independent of display device 114, or credit display 210 and bet display 212 may be incorporated into display device 114. As described in additional detail below, display device 114 can display game play using a single frame, including a single credit display 210 and a single bet display 212. In addition, display device 114 can display game play using a plurality of frames by splitting or dividing the original, single frame. Each of the newly formed frames can include a respective credit display 210 and bet display 212. Moreover, as described in additional detail below, the credits associated with each of the multiple frames is drawn from the same available credit pool as the credit displayed on the original, single frame. Accordingly, credit display 210 and bet display 212 associated with the multiple frames operate substantially the same as credit display 210 and bet display 212 associated with the single frame.

Moreover, in an exemplary embodiment, display device 114 is controlled by controller 202. In some embodiments, display device 114 includes a touch screen 214 and an associated touch screen controller 216. A video controller 218 is communicatively coupled to controller 202 and touch screen controller 216 to enable a player to input game play decisions into gaming machine 100 via touch screen 214. Furthermore, gaming machine 100 includes one or more communication ports 220 that enable controller 202 to communicate with external peripheral devices (not shown) such as, but not limited to, external video sources, expansion buses, game or other displays, a SCSI port, or a key pad.

Figure 3:
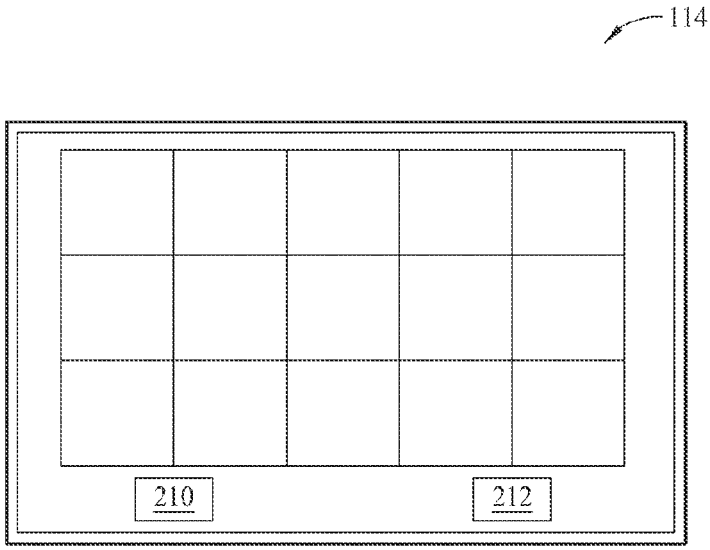
FIG. 3 is a view of an exemplary gaming machine display device during play of a game in a first frame.
Figure 4:
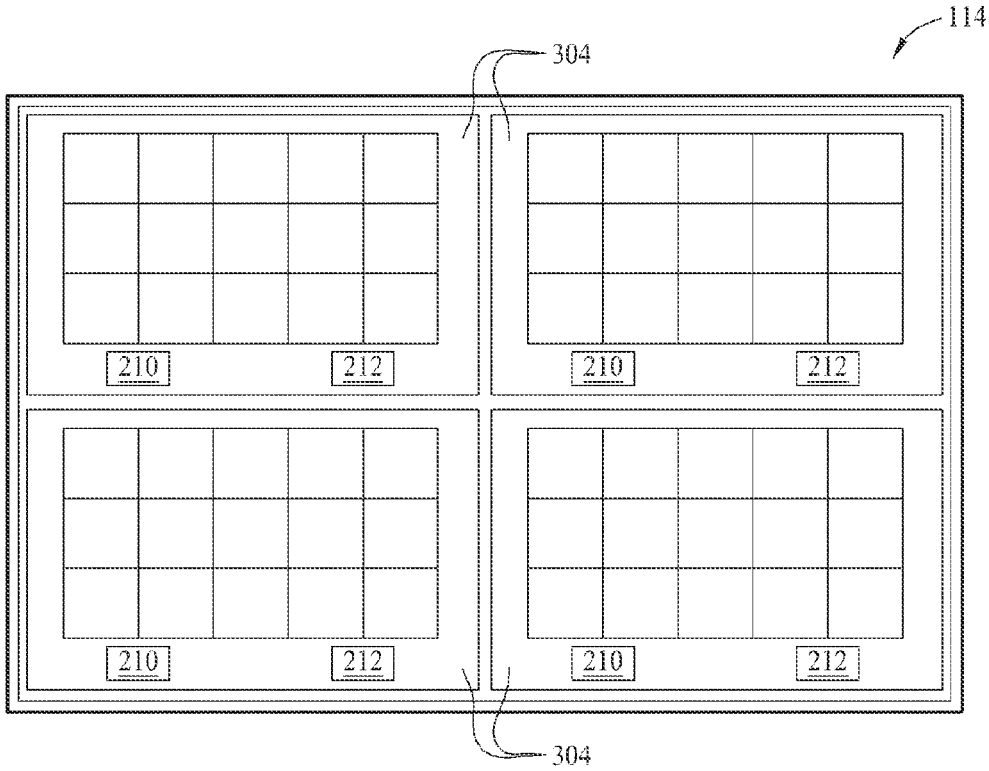
FIG. 4 is a view of an exemplary gaming machine display device during play of a game in a plurality of second frames.

FIG. 3 is a view of display device 114 during play of a game in a first frame 302. FIG. 4 is a view of display device 114 during play of the game in a plurality of second frames 304. As shown in both FIGS. 3 and 4, each frame 302 and 304 includes a respective credit display 210 and bet display 212. When the number of credits shown in credit displays 210 of second frames 304 is summed, the number is the same as the number of credits shown in credit display 210 of first frame 302. Accordingly, the number of credits available to a player for use in playing a game using only first frame 302 is divided between each second frame 304. In one embodiment, the player can divide first frame 302 into second frames 304 at any point during game play. For example, the player can designate the number of second frames 304 via, for example, touch screen 214 and/or buttons 104 (both shown in FIGS. 1 and 2). The player can also designate a desired wager for each second frame 304, and controller 202 will update bet displays 212 accordingly. In such an embodiment, the player may designate different proportions of available credits to each second frame bet display 212.

In an alternative embodiment, controller 202 detects a trigger condition during play of the game in first frame 302 and causes display device 114 to divide first frame 302 into second frames 304. For example, the type of trigger condition detected by controller 202 can determine the number of second frames 304. Alternatively, in response to the trigger condition, controller 202 prompts the player to input a decision to divide first frame 302 into second frames 304 and/or to input a number of second frames 304. In yet another embodiment, upon detection of a trigger condition, the division of first frame 302 into second frames 304 is carried out autonomously according to predefined parameters without involving a player's decision.

In another alternative embodiment, the player can select from a number of available games to play in each second frame 304. In some embodiments, each game uses a separate paytable stored in memory area 206 (shown in FIG. 2).

During operation, controller 202 causes display device 114 to display a game using first frame 302. During play of the game in first frame 302, controller 202 determines a game outcome, such as a first game outcome, and causes display device 114 to display the first outcome using first frame 302. Moreover, during play of the game in first frame 302, the player can input a command via, for example, touch screen 214 and/or buttons 104. In response to the command, controller 202 divides first frame 302 into second frames 304 and causes display device 114 to display second frames 304. Alternatively, controller 202 may detect a trigger condition during game play in first frame 302. In response to the trigger condition, such as a predefined game outcome, controller 202 divides first frame 302 into second frames 304 and causes display device 114 to display second frames 304.

Moreover, in exemplary embodiments, a number of available credits in credit display 210 are divided between credit displays 210 of second frames 304. The available credits may be evenly divided, may be divided according to player inputs, or may be divided according to one or more paytables or according to the trigger condition and predefined apportionment. Further, as described in more detail below with reference to FIG. 7, wagered credits may be reallocated (e.g., at an intermediate stage of game play) between the games displayed in second frames 304.

In the exemplary embodiment, controller 202 enables continued play of the game separately within each second frame 304. For example, controller 202 generates a respective game outcome, such as a second game outcome, for each second frame 304 independent of each other, such that no one game outcome depends on another game outcome. Alternatively, one or more game outcomes in second frames 304 may be dependent on each other. In the exemplary embodiment, controller 202 causes display device 114 to display a respective second outcome of the game using second frames 304. Any awards associated with a second game outcome are credited to credit display 210 of the same second frame 304.

In the exemplary embodiment, the player elects when to merge second frames 304 into first frame 302. For example, controller 202 merges second frames 304 into first frame 302 and causes display device 114 to display first frame 302. Moreover, controller 202 enables continued play of the game within first frame 302. When merging second frames 304 to form first frame 302, controller 202 merges or adds available credits shown by credit displays 210 of second frames 304, and displays the total number of available credits in credit display 210 of first frame 302. In addition, controller 202 merges or adds wagered credits shown by bet displays 212 of second frames 304, and displays the total number of wagered credits in bet display 212 of first frame 302. In some embodiments, a game available for play in first frame 302 after merging second frames 304 is the same game played in first frame 302 prior to being divided. Alternatively, a game available for play in first frame 302 after merging second frames 304 is different than the game played in first frame 302 prior to being divided.

Moreover, in some embodiments, the player may select a different number of frames, such as a plurality of third frames (not shown), to be formed by merging only a portion of second frames 304. For example, the player may select only two second frames 304 to merge into a single third frame while leaving a remaining two second frames 304 unmerged. Furthermore, in some embodiments, the player may further divide one or more second frames 304 into a plurality of separate third frames.

Figure 5:
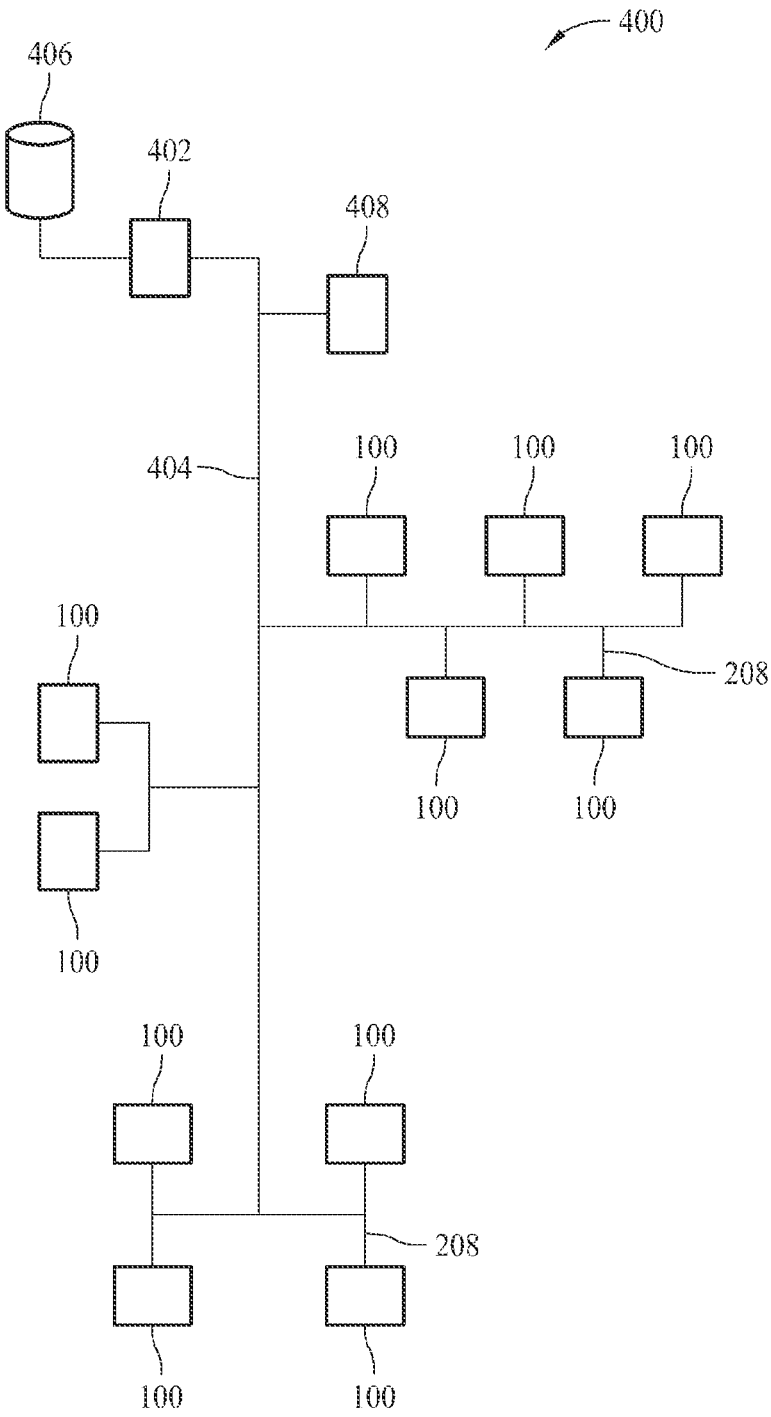
FIG. 5 is a block schematic diagram of an exemplary gaming system that includes a plurality of gaming machines shown in FIG. 1.

FIG. 5 is a block schematic diagram of an exemplary gaming system 400 that includes a plurality of gaming machines 100. Each gaming machine 100 is coupled via network interface 208 to one or more servers, such as a gaming server 402, using a network 404. Gaming server 402 includes a processor (not shown) that facilitates data communication between each gaming machine 100 and other components of gaming system 400. Such data is stored in, for example, a memory area 406, such as a database, that is coupled to gaming server 402.

As described above, gaming machines 100 may include video bingo machines, video poker machines, video slot machines, and/or other similar gaming machines that implement alternative games. Moreover, gaming machines 100 may be terminal-based machines, wherein the actual games, including random number generation and/or outcome determination, are performed at gaming server 402. In such an embodiment, gaming machine 100 displays results of the game via display device 114 (shown in FIGS. 1 and 2).

Moreover, in the exemplary embodiment, gaming system 400 includes a configuration workstation 408 that includes a user interface that enables an administrator to set up and/or to modify portions of gaming system 400 and/or gaming server 402. Gaming server 402 may perform a plurality of functions including, for example, game outcome generation, player tracking functions, and/or accounting functions. However, in alternative embodiments, gaming system 400 may include a plurality of servers that separately perform these functions and/or any suitable function for use in a network-based gaming system. In the exemplary embodiment, gaming server 402 controls bonus applications or bonus systems that award bonus opportunities on gaming system 400. Moreover, gaming server 402 includes a set of rules for awarding jackpots in excess of those established by winning pay tables (not shown) of each gaming machine 100. Some bonus awards may be awarded randomly, while other bonus awards may be made to groups of gaming machines 100 operating in a progressive jackpot mode.

Moreover, in some embodiments, gaming server 402 tracks data of players using gaming machines 100, and also controls messages that appear on display device 114 of gaming machines 100. For example, gaming server 402 can store physical characteristics of players, such as, but not limited to, the player age. Gaming server 402 can also store data related to the players and tracked using player tracking identification, such as a player card. Moreover, gaming server 402 can store information and data about the player such as loyalty points, player address, phone number, and/or any information that may be retrieved and transmitted to gaming machines 100. In some embodiments, gaming server 402 stores and tracks information such as, but not limited to, the average amount of wager played at gaming machine 100. Moreover, gaming server 402 can track an average amount of wagers by the player, any funds the player may have in an account, and data relating to reportable events. Such data is associated with individual players and logged using a taxable accrual log.

Furthermore, and in the exemplary embodiment, gaming server 402 is configured to enable a player to split or divide a game played in a single frame into a plurality of games played in a plurality of frames, as described above. For example, as described in additional detail below, gaming server 402 causes display device 114 to divide a first frame into a plurality of second frames during play of a game in the first frame, wherein each second frame separately enables continued play of the game. Moreover, gaming server 402 causes display device 114 to merge the plurality of second frames into the first frame during play of the game in the second frames and enables continued play of the game within the first frame.

Figure 6:
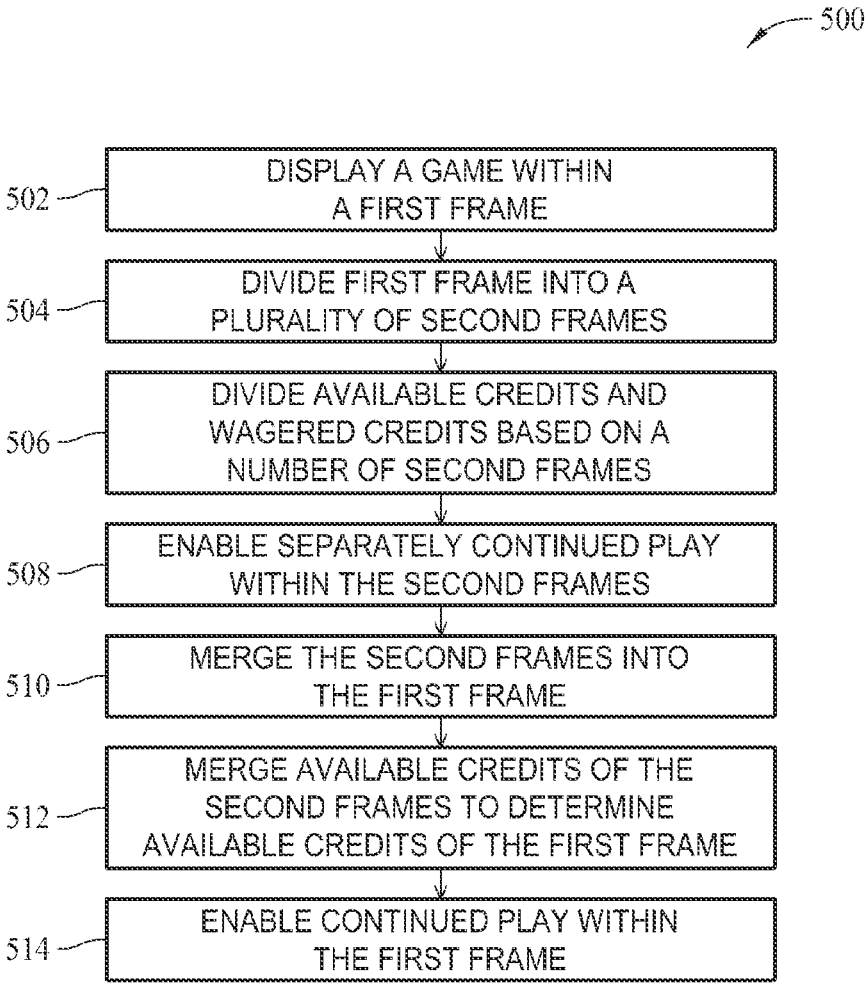
FIG. 6 is a flowchart that illustrates an exemplary method for dividing and/or merging frames during game play at the gaming machine shown in FIG. 1.

FIG. 6 is a flowchart 500 that illustrates an exemplary method for dividing and/or merging frames during game play at gaming machine 100 (shown in FIGS. 1 and 2). In the exemplary embodiment, controller 202 (shown in FIG. 2) displays 502 a game by display device 114 (shown in FIGS. 1 and 2) using first frame 302 (shown in FIG. 3). Moreover, controller 202 displays credit display 210 and bet display 212 (both shown in FIGS. 2 and 3) using first frame 302. Alternatively, gaming server 402 (shown in FIG. 5) causes display device 114 to display 502 the game in first frame 302.

In the exemplary embodiment, and during play of the game in first frame 302, controller 202 or, alternatively, server 402, divides 504 first frame 302 into a plurality of second frames 304 and causes display device 114 to display second frames 304. In one embodiment, a player input prompts controller 202 or server 402 to divide first frame 302. In an alternative embodiment, controller 202 or server 402 detects a trigger condition and divides first frame 302 into second frames 304 according to the trigger condition. In another alternative embodiment, and in response to detecting a trigger condition, controller 202 or server 402 prompts the player to decide whether to divide first frame 302 into second frames 304. In some embodiments, the player can designate a number of second frames 304. In other embodiments, a trigger condition determines a number of second frames 304. In the exemplary embodiment, controller 202 or server 402 also divides 506 a number of available credits and displays each portion in a respective credit display 210 of second frames 304. Moreover, controller 202 or server 402 enables 508 separately continued play of the game within second frames 304. For example, each second frame 304 enables separate play of the game as if it were an independent gaming machine 100. Accordingly, controller 202 or server 402 executes code associated with each second frame 304 in an isolated thread, for example. As such, for each second frame 304, controller 202 or server 402 separately generates a game outcome. In an alternative embodiment, game outcomes for second frames 304 may be interdependent.

In the exemplary embodiment, and during play of the game in one or more second frames 304, controller 202 or server 402 merges 510 second frames 304 into first frame 302 and causes display device 114 to display first frame 302. In one embodiment, a player input prompts controller 202 or server 402 to merge second frames 304. In an alternative embodiment, controller 202 or server 402 detects a trigger condition and merges second frames 304 into first frames 302 according to the trigger condition. In another alternative embodiment, and in response to detecting a trigger condition, controller 202 or server 402 prompts the player to decide whether to merge second frames 304 into first frame 302. In the exemplary embodiment, controller 202 or server 402 also merges 512 the available credits in credit displays 210 of second frames 304 into credit display 210 of first frame 302. Controller 202 or server 402 also merges the wagered credits in bet displays 212 of second frames 304 into bet display 212 of first frame 302. Moreover, controller 202 or server 402 enables 514 continued play of the game within first frame 302.

Figure 7:
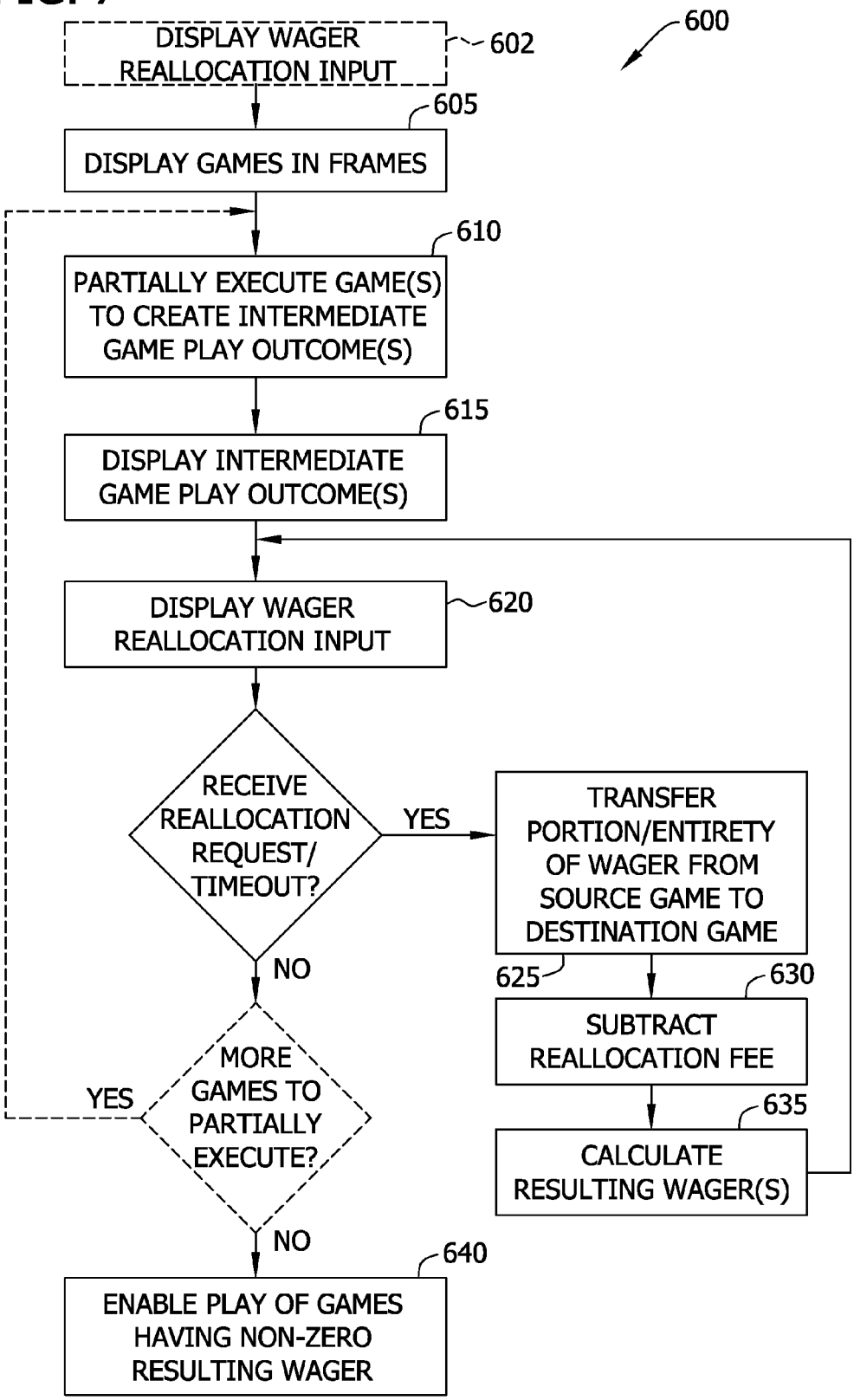
FIG. 7 is a flowchart that illustrates an exemplary method for reallocating wagers between games during game play at the gaming machine shown in FIG. 1.

FIG. 7 is a flowchart 600 that illustrates an exemplary method for reallocating wagers between games during game play at gaming machine 100 (shown in FIGS. 1 and 2). Flowchart 600 is described below with reference to controller 202. However, the method described may be performed by any computing device or combination of computing devices, such as a gaming machine 100 and/or gaming server 402 (shown in FIG. 5). For example, gaming server 402 may perform some operations of the method, and one or more gaming machines 100 may perform other operations of the method.

In exemplary embodiments, controller 202 (shown in FIG. 2) displays 605 a plurality of games by display device 114 (shown in FIGS. 1 and 2) using a plurality of frames, such as second frames 304, described above with reference to FIG. 4. The games displayed 605 by controller 202 may be split from a single game by a player, or game play may begin with a plurality of games.

Controller 202 partially executes 610 at least one game of the plurality of games to create an intermediate game play outcome associated with each partially executed game. In exemplary embodiments, a game includes a plurality of game pieces, such as reel stop positions (also known as reel stops), die faces, and/or playing cards, each of which is associated with one or more values and/or symbols. For example, a reel stop may be associated with a symbol, such as a bar or a fruit, and a die face may be associated with a numeric value (e.g., between one and six). As another example, a playing card may be associated with a magnitude (e.g., between two and ace) and a suit (e.g., clubs or hearts). In such embodiments, a game is executed by randomly selecting a plurality of game pieces. A game play outcome is determined based on the selected game pieces. Further, a game may be partially executed 610 by randomly selecting a portion (e.g., one or more) of the game play pieces, leaving the remainder of the game play pieces to be selected later. This selected portion of game play pieces may be referred to as an intermediate game play outcome.

In some embodiments, a game allows the player to trade or discard one or more selected game play pieces in exchange for another randomly selected game play piece. For example, in the poker game five card draw, the player may typically discard up to three cards, and each discarded card is replaced by another randomly selected card. Similarly, a player may be allowed to hold one or more dice or reel stops, and to acquire replacements for the non-held dice or reel stops by re-rolling or re-spinning, respectively. In such embodiments, a game may be partially executed 610 by selecting a full set of game play pieces and pausing before allowing the player to trade or discard game play pieces.

In some embodiments, an intermediate game play outcome includes a predicted payout (e.g., a number of credits that are predicted to be awarded) based on the selected game play pieces. For example, in a poker game where three cards have been selected for, or "dealt to," the player, if the three selected cards include a pair (two cards with the same magnitude), the intermediate game play outcome may include a payout associated with a pair in the game's paytable.

Figure 8:
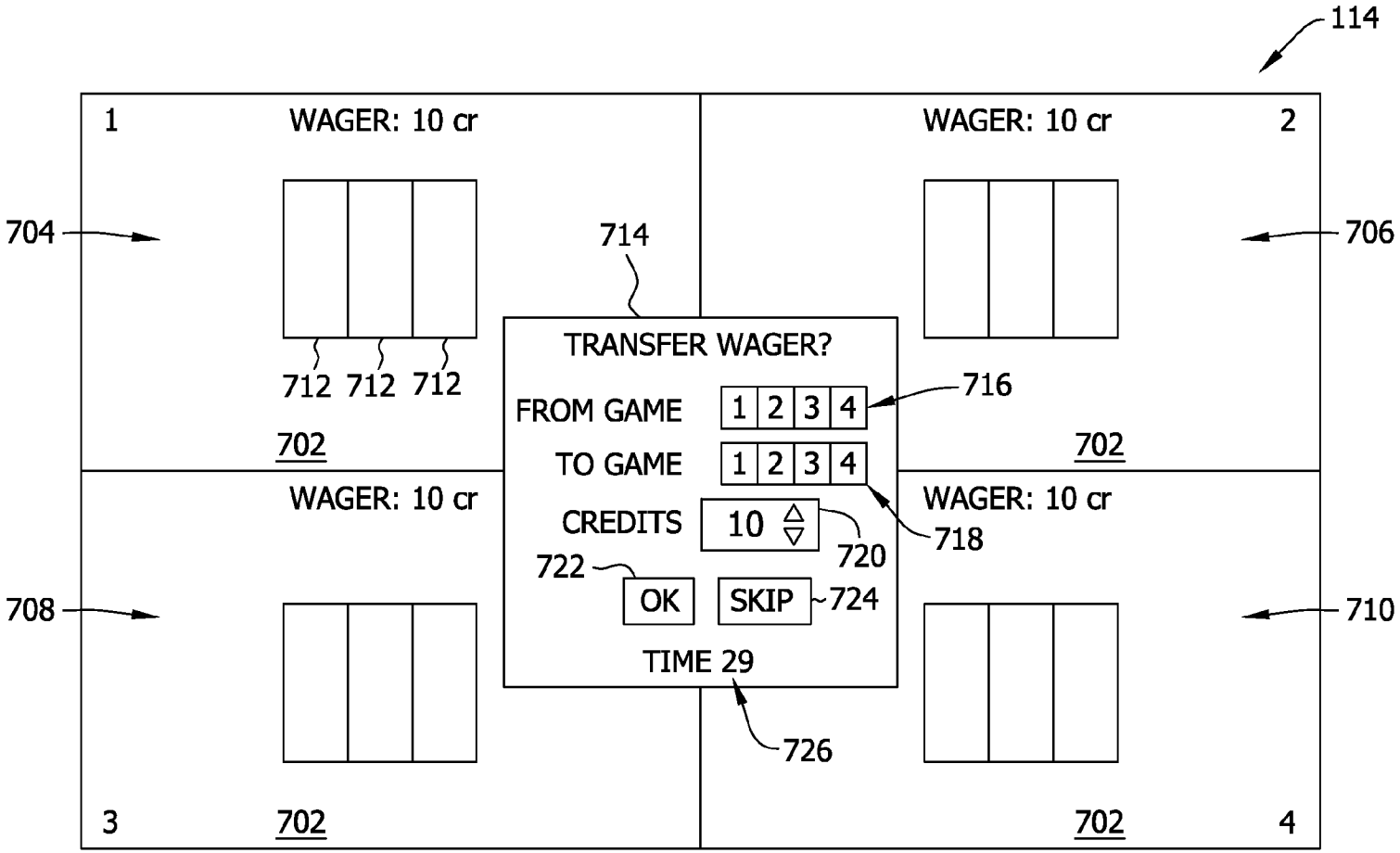
FIG. 8 is a view of an exemplary gaming machine display device displaying intermediate game play outcomes.

Controller 202 causes display device 114 to display 615 the intermediate game play outcome and a wager reallocation input prompting a player to enter a reallocation request. FIG. 8 is view of display device 114 displaying 615 intermediate game play outcomes in a plurality of frames 702. In the example shown in FIG. 8, four partially executed games (a first game 704, a second game 706, a third game 708, and a fourth game 710) are displayed 615 in four frames 702, each of which is associated with one game. Each game includes three reels 712, two of which have been "spun" (e.g., are associated with selected symbols).

Displaying 615 intermediate game play outcomes enables the player to evaluate the likelihood of a winning final game play outcome in each game. For example, if a paytable associated with the games defines payouts only for games in which three matching reel stops are selected, the player may determine that any game with mismatched reel stops in the intermediate game play outcome will not produce a winning outcome. Similarly, the paytable may define payouts for particular combinations, sequences, and/or other patterns of game play pieces such as reel stops. The player may evaluate an intermediate game play outcome with respect to any such pattern.

Controller 202 also causes display device 114 to display 620 a wager reallocation input 714. In the example shown in FIG. 8, wager reallocation input 714 includes a wager source selector 716, a wager destination selector 718, and a reallocation amount selector 720. Wager source selector 716 and wager destination selector 718 enable the player to select the game from which a wager will be reallocated and the game to which the wager will be reallocated, respectively. Reallocation amount selector 720 enables the player to select the portion of the wager in the source game that will be reallocated to the destination game. The portion of the wager to reallocate may be expressed as a quantity of credits and/or currency, as a proportion (e.g., a fraction or a percentage) of a wager, and/or in any other suitable terms.

In exemplary embodiments, reallocation amount selector 720 limits the reallocated portion to values that are greater than zero and less than a maximum reallocation amount. The maximum reallocation amount may be a predetermined reallocation limit (e.g., expressed as a quantity of credits), the amount of credits wagered in the selected source game, the amount of credits wagered in the selected source game less a reallocation fee, or the lesser of any combination of such values. For example, if controller 202 is configured with a reallocation limit of five credits, and the selected source game is associated with a wager of three credits, a maximum of three credits may be reallocated from the source game. As another example, if controller 202 is configured with a reallocation limit of five credits, and the selected source game is associated with a wager of ten credits, a maximum of five credits may be reallocated from the source game. In some embodiments, controller 202 automatically populates reallocation amount selector 720 with the maximum reallocation amount. For example, reallocation amount selector 720 may be updated when a source game is chosen in wager source selector 716.

Wager reallocation input 714 also includes an OK button 722 and a skip button 724. Selection of OK button 722 by the player causes wager reallocation input 714 to initiate a wager reallocation request to controller 202. Based on wager reallocation input 714 (e.g., in response to receiving the wager reallocation request), controller 202 transfers 625 at least a portion (e.g., up to and including the entirety) of the wager from the source game selected in wager source selector 716 to the destination game selected in wager destination selector 718. For example, if first game 704 is the source game, and second game 706 is the destination game, controller 202 transfers 625 the quantity of credits selected in reallocation amount selector 720 from first game 704 to second game 706.

In some embodiments, controller 202 may subtract 630 a reallocation fee from the source wager, the destination wager, and/or the transferred portion of the source wager. The reallocation fee may be credited to the operator of the gaming machine and/or to any party designated by such an operator. The reallocation fee may be a predetermined quantity of credits, quantity of currency, and/or proportion of the transferred portion.

Further, in some embodiments, the reallocation fee may be based at least in part on the probability of the source game and/or the destination game resulting in a non-winning or winning outcome. For example, such a probability may be calculated based on the intermediate game play outcome, the quantity of game pieces that remain to be selected, and the paytable associated with the game. In such embodiments, the reallocation fee may be greater when the probability of the destination game resulting in a winning outcome is greater than a predetermined threshold value and/or when the probability of the source game resulting in a non-winning outcome is greater than a predetermined threshold value.

After transferring 625 the wager from the source game to the destination game and, optionally, subtracting 630 a reallocation fee, controller 202 calculates 635 the resulting wager associated with the source game and the resulting wager associated with the destination game based on the corresponding original wagers and the reallocation performed. For example, the transferred portion may be subtracted from the source game and added to the destination game, less any reallocation fee.

In exemplary embodiments, controller 202 enables the execution of multiple wager reallocations with respect to a single game or set of games. For example, after transferring 625 the selected portion of the wager from the source game to the destination game and, optionally, subtracting 630 a reallocation fee, controller 202 may again cause display device 114 to display 620 a wager reallocation input 714, as described above. Accordingly, while intermediate game play outcomes are displayed 615, the player may reallocate wagers from a plurality of source games to a single destination game, from a single source game to a plurality of destination games, and/or any combination of the above. For example, based on reallocation requests from the player, controller 202 may transfer at least a portion of a first wager associated with first game 704 and at least a portion of a third wager associated with third game 708 to second game 706.

Before any reallocations or after any quantity of reallocations, the player may select skip button 724. When skip button 724 is selected, no further wager reallocation requests are received by controller 202, and no further reallocation of wagers occurs. After performing any wager reallocations requested by the player, controller 202 enables 640 play of all games that are associated with a non-zero resulting wager. In exemplary embodiments, such games are executed to determine a final game play outcome based on the resulting wagers.

As described above, controller 202 may display 620 wager reallocation input 714 after displaying 615 one or more intermediate game play outcomes. In addition, or alternatively, controller 202 may display 602 a wager reallocation input 714 prior to displaying 615 such intermediate outcomes, enabling the player to define one or more reallocation rules. For example, a reallocation rule may be specified by the player before controller 202 displays 605 games to the player.

A reallocation rule associates a reallocation action with a condition. For example, a reallocation rule may specify that when game play in any frame 702 results in a losing streak (e.g., quantity of non-winning outcomes) greater than a threshold value (e.g., five games), 50% of the wager from that frame should be reallocated evenly to the games in the other frames 702, or to a randomly selected frame 702. In this example, the losing streak is the condition, and the reallocation of 50% of the wager is the reallocation action.

In such embodiments, controller 202 may automatically transfer 625 wagers from source games to destination games based on reallocation rules whose conditions are satisfied during game play. Alternatively, controller 202 may display 620 one or more wager reallocation inputs 714 based on the reallocation rule. For example, if the rule specifies that 50% of a wager associated with first game 704 is to be reallocated to second game 706, controller 202 may pre-populate wager reallocation input 714 to indicate first game 704 in wager source selector 716, second game 706 in wager destination selector 718, and five credits (half of the wager of first game 704) in reallocation amount selector 720. The player may accept the reallocation action of the rule by selecting OK button 722, modify the reallocation and select OK button 722, or prevent the reallocation by selecting skip button 724.

Further, in some embodiments, controller 202 displays a countdown timer 726 that initially displays a predetermined timeout duration (e.g., thirty seconds) and proceeds to display a remaining timeout duration that decreases as the current time advances. For example, countdown timer 726 may display values that decrease from the predetermined timeout duration until the remaining timeout duration equals zero. When the remaining timeout duration is zero, a timeout occurs. When a timeout occurs after wager reallocation input 714 is displayed 620 based on a reallocation rule whose condition has been satisfied, controller 202 applies the rule (e.g., performs the reallocation action specified in the rule) as if the player had selected OK button 722 without modifying any values. When a timeout occurs after no rule condition has been satisfied, controller 202 performs no reallocation.

In some embodiments, one or more reallocation rules are defined as default rules. For example, the default rules may be associated with the game, such that the default rules are applied for each player of the game. Optionally, controller 202 may enable the player to modify and/or delete the default rules by displaying 602 a default rule in a wager reallocation input 714, as described above.

In some embodiments, and as shown in FIG. 8, controller 202 displays 615 intermediate game play outcomes associated with all games being played simultaneously, and then displays 620 a wager reallocation input. In other embodiments, controller 202 partially executes 610 only a portion of the games, displays 615 intermediate game play outcomes associated with the partially executed game(s), and displays 620 a wager reallocation input prior to partially executing 610 one or more remaining games. Such embodiments provide a blind reallocation feature by enabling the player to reallocate a wager from a visible source game to an invisible destination game, from an invisible source game to a visible destination game, and/or any combination of the above. Similarly, controller 202 may achieve such a blind reallocation feature by partially executing 610 all games but displaying 615 only the intermediate game play outcomes associated with a portion of the games.

Accordingly, games may be partially executed 610, and/or intermediate game play outcomes may be displayed 615, in a sequence, with a wager reallocation input displayed 620 between partial executions 610 and/or displays 615. For example, after displaying 615 a first intermediate game play outcome associated with first game 704, but while no intermediate game play outcome is shown for second game 706, controller 202 may display 620 a wager reallocation input and transfer 625 a portion of a first wager associated with first game 704 to second game 706 based on a wager reallocation request from the player. Then controller 202 may display 615 a second intermediate game play outcome associated with second game 706 and again display 620 a wager reallocation input, allowing the player to reallocate a portion of a second wager associated with second game 706. The process described above may be repeated until all games being played have been partially executed 610 and/or until an intermediate game play outcome has been displayed 615 for all games being played.

Exemplary embodiments of systems and methods for providing a split and merge or unsplit feature on a gaming machine, and for reallocating wagers between games, are described above in detail. The systems and methods are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present invention is described in connection with an exemplary gaming system environment, embodiments of the invention are operational with numerous other general purpose or special purpose gaming system environments or configurations. The gaming system environment is not intended to suggest any limitation as to the scope of use or functionality of any aspect of the invention. Moreover, the gaming system environment should not be interpreted as having any dependency or requirement relating to any one or combination of components illustrated in the exemplary operating environment.

Embodiments of the invention may be described in the general context of computer-executable instructions, such as program components or modules, executed by one or more computers or other devices. Aspects of the invention may be implemented with any number and organization of components or modules. For example, aspects of the invention are not limited to the specific computer-executable instructions or the specific components or modules illustrated in the figures and described herein. Alternative embodiments of the invention may include different computer-executable instructions or components having more or less functionality than illustrated and described herein.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, the term "database" refers generally to any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

When introducing elements of aspects of the invention or embodiments thereof, the articles "a," "an," "the," and "said" are intended to mean that there are one or more of the elements. The terms "comprising," "including," and "having" are intended to be inclusive and mean that there may be additional elements other than the listed elements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gaming machine comprising;

a display device; and a processor coupled to said display device and programmed to:

cause said display device to display a plurality of games using a plurality of frames;

partially execute at least a first game of the plurality of games to create an intermediate game play outcome;

cause said display device to display the intermediate game play outcome and a wager reallocation input;

transfer, based on the wager reallocation input, at least a portion of a first wager associated with the first game to a second game of the plurality of games;

subtract a reallocation fee from at least one of the first wager and the transferred portion of the first wager, wherein the reallocation fee is credited to an operator of the gaming machine; and enable play of the second game based on a second wager associated with the second game and the transferred portion of the first wager.

2. A gaming machine in accordance with claim 1, wherein the intermediate game play outcome is a first intermediate game play outcome, and said processor is further programmed to:

partially execute the second game to create a second intermediate game play outcome; and cause said display device to display the first and second intermediate game play outcomes simultaneously.

3. A gaming machine in accordance with claim 2, wherein the second game is associated with a second wager, and said processor is further programmed to:

partially execute a third game of the plurality of games to create a third intermediate game play outcome; and transfer, based on the reallocation input, at least a portion of a third wager associated with the third game to the second game.

4. A gaming machine in accordance with claim 1, wherein the intermediate game play outcome is a first intermediate game play outcome, and said processor is further programmed to partially execute the second game to create a second intermediate game play outcome after transferring at least a portion of the first wager to the second game.

5. A gaming machine in accordance with claim 4, wherein the wager reallocation input is a first wager reallocation input, and said processor is further programmed to:

cause said display device to display the second intermediate game play outcome and a second wager reallocation input that is equal to or different from the first wager reallocation input;

transfer, based on the second wager reallocation input, at least a portion of the second wager to a third game of the plurality of games; and enable play of the third game based on a third wager associated with the third game and the transferred portion of the second wager.

6. A gaming machine in accordance with claim 1, wherein said processor is further programmed to transfer the entirety of the first wager to the second game.

7. A gaming machine in accordance with claim 1, wherein said processor is further programmed to transfer the entirety of the first wager, less the reallocation fee, to the second game.

8. A gaming machine in accordance with claim 1, wherein said processor is further programmed to:

calculate a resulting first wager based on the first wager and the transferred portion of the first wager; and further execute the first game to create a final game play outcome based on the resulting first wager.

9. A gaming system comprising:

at least one gaming machine comprising a display device configured to display a plurality of games using a plurality of frames; and a gaming server coupled to said at least one gaming device via a network, said gaming server configured to:

during play of a first game of the plurality of games, cause said display device to display an intermediate game play outcome and a wager reallocation input, wherein the intermediate game play outcome is associated with the first game;

transfer, based on the wager reallocation input, at least a portion of a first wager associated with the first game to a second game of the plurality of games;

subtract a reallocation fee from at least one of the first wager and the transferred portion of the first wager, wherein the reallocation fee is credited to an operator of the gaming machine; and enable play of the second game based on a second wager associated with the second game and the transferred portion of the first wager.

10. A gaming system in accordance with claim 9, wherein the intermediate game play outcome is a first intermediate game play outcome, and wherein said gaming server is further configured to, during play of the second game, cause said display device to display a second intermediate game play outcome.

11. A gaming system in accordance with claim 10, wherein said gaming server causes said display device to display the first and second intermediate game play outcomes simultaneously.

12. A gaming system in accordance with claim 11, wherein the second game is associated with a second wager, and said gaming server is further configured to:

partially execute a third game of the plurality of games to create a third intermediate game play outcome; and transfer, based on the wager reallocation input, at least a portion of a third wager associated with the third game to the second game.

13. A gaming system in accordance with claim 9, wherein the intermediate game play outcome is a first intermediate game play outcome, and said gaming server is further configured to cause said display device to display a second intermediate game play outcome associated with the second game after transferring at least a portion of the first wager to the second game.

14. A gaming system in accordance with claim 13, wherein the wager reallocation input is a first wager reallocation input, and said gaming server is further configured to:

cause said display device to display the second intermediate game play outcome and a second wager reallocation input that is equal to or different from the first wager reallocation input;

transfer, based on the second reallocation input entered by the player, at least a portion of the second wager to a third game of the plurality of games; and enable play of the third game based on a third wager associated with the third game and the transferred portion of the second wager.

15. A method for use with a gaming machine having a display device, said method comprising:

displaying by the display device a plurality of games in a plurality of frames;

partially executing at least a first game of the plurality of games by a processor to create an intermediate game play outcome;

displaying by the display device the intermediate game play outcome and a wager reallocation input;

transferring by the processor at least a portion of a first wager associated with the first game to a second game of the plurality of games based on the reallocation input; and subtracting a reallocation fee from at least one of the first wager and the transferred portion of the first wager, wherein the reallocation fee is credited to an operator of the gaming machine.

16. A method in accordance with claim 15, further comprising:

partially executing the second game by the processor to create a second intermediate game play outcome; and displaying the first and second intermediate game play outcomes by the display device simultaneously.

17. A method in accordance with claim 16, wherein displaying the first and second intermediate game play outcomes comprises:

displaying the first intermediate game play outcome in a first frame of the plurality of frames, wherein the first frame is associated with the first game; and displaying the second intermediate game play outcome in a second frame of the plurality of frames, wherein the second frame is associated with the second game.

18. A method in accordance with claim 15, wherein the intermediate game play outcome is a first intermediate game play outcome, said method further comprising partially executing the second game to create a second intermediate game play outcome after transferring at least a portion of the first wager to the second game.

19. A method in accordance with claim 18, wherein the wager reallocation input is a first wager reallocation input, said method further comprising:

displaying by the display device the second intermediate game play outcome and a second wager reallocation input that is equal to or different from the first wager reallocation input; and transferring by the processor at least a portion of the second wager to a third game of the plurality of games based on the second wager reallocation input entered by the player.

20. A method in accordance with claim 15, further comprising:

calculating by the processor a resulting first wager based on the first wager and the transferred portion of the first wager; and further executing the first game to create a final game play outcome based on the resulting first wager.

* * * * *